US010464309B2

(12) United States Patent
Uchida

(10) Patent No.: US 10,464,309 B2
(45) Date of Patent: Nov. 5, 2019

(54) PRINTING APPARATUS AND CONTROL METHOD

(71) Applicant: CANON KABUSHIKI KAISHA, Tokyo (JP)

(72) Inventor: Kota Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/920,823

(22) Filed: Mar. 14, 2018

(65) Prior Publication Data

US 2018/0281381 A1 Oct. 4, 2018

(30) Foreign Application Priority Data

Mar. 31, 2017 (JP) ..... 2017-072080

(51) Int. Cl.
*B41J 2/01* (2006.01)
*B41J 2/005* (2006.01)

(52) U.S. Cl.
CPC ..... *B41J 2/0057* (2013.01); *B41J 2/01* (2013.01); *B41J 2002/0052* (2013.01); *B41J 2002/012* (2013.01)

(58) Field of Classification Search
CPC ..... B41J 2/0057; B41J 2002/012
USPC ..... 347/104
See application file for complete search history.

(56) References Cited

U.S. PATENT DOCUMENTS 6,375,319 B1 * 4/2002 Kamano ..... B41J 13/025 347/104
6,682,189 B2 1/2004 May et al.
6,767,092 B2 7/2004 May et al.
7,661,809 B2 * 2/2010 Taniuchi ..... B41J 2/0057 347/101
7,909,454 B2 * 3/2011 Koto ..... B41J 13/223 101/118
8,337,008 B2 * 12/2012 Kachi ..... B41J 11/002 347/101
9,321,072 B2 4/2016 Uemura et al.

FOREIGN PATENT DOCUMENTS

JP 2003-182064 A 7/2003
JP 2014-018988 A 2/2014

* cited by examiner

*Primary Examiner* — Lam S Nguyen
(74) *Attorney, Agent, or Firm* — Venable LLP

(57) ABSTRACT

A printing apparatus includes a transfer drum configured to rotate while supporting a plurality of transfer members on each of which an image is formed by discharging ink from a printhead, a rotating member configured to apply a processing liquid while being pressed against each of the plurality of transfer members, and a concave portion formed lower than a surface of each of the plurality of transfer members between the adjacent transfer members. In addition, the printing apparatus includes a driving unit configured to driven-rotate the rotating member in accordance with rotation of the transfer drum in a state in which the rotating member is pressed against the plurality of transfer members, and driving-rotate the rotating member in a state in which the rotating member faces the concave portion.

11 Claims, 14 Drawing Sheets

PRINTING APPARATUS AND CONTROL METHOD

BACKGROUND OF THE INVENTION

Field of the Invention

The present invention relates to a transfer type printing technique.

Description of the Related Art

A technique of forming an ink image on a transfer member and transferring it to a print medium such as paper is proposed. For example, Japanese Patent Laid-Open No. 2003-182064 discloses an image forming apparatus configured to form an ink image on an intermediate member and transfer the ink image to a sheet. This apparatus includes an inkjet device that forms a primary image on the intermediate member. This apparatus also includes a zone where an aggregate is formed in the primary image, a zone where a liquid is partially removed from the aggregate, a zone where an image is transferred to a sheet, and a zone where the surface of the intermediate member is reproduced before a new primary image is formed. Japanese Patent Laid-Open No. 2014-18988 discloses an apparatus that applies a liquid onto paper on a drum using an application roller.

Similarly to the apparatus described in Japanese Patent Laid-Open No. 2003-182064, a processing apparatus that supplies a liquid onto a portion around a transfer member or removes a liquid from the portion includes, for example, a rotating member such as a roller pressed against the transfer member. In an arrangement in which a plurality of transfer members are supported, when a concave portion between the adjacent transfer members faces the rotating member, the rotating member is not temporarily pressed against the transfer member, and thus the rotation speed of the rotating member may decrease. This may wear the surfaces of the roller and transfer member when they are pressed again against each other. This may also change the moving speed of the transfer member.

SUMMARY OF THE INVENTION

The present invention provides a technique of reducing a decrease in speed of a rotating member when the rotating member passes between adjacent transfer members in an arrangement in which a plurality of transfer members are supported.

According to an aspect of the present invention, there is provided a printing apparatus comprising: a transfer drum configured to rotate while supporting a plurality of transfer members on each of which an image is formed by discharging ink from a printhead; a rotating member configured to apply a processing liquid while being pressed against each of the plurality of transfer members; a concave portion formed lower than a surface of each of the plurality of transfer members between the adjacent transfer members; and a driving unit configured to driven-rotate the rotating member in accordance with rotation of the transfer drum in a state in which the rotating member is pressed against the transfer member, and driving-rotate the rotating member in a state in which the rotating member faces the concave portion.

Further features of the present invention will become apparent from the following description of exemplary embodiments (with reference to the attached drawings).

DESCRIPTION OF THE EMBODIMENTS

Embodiments of the present invention will be described with reference to the accompanying drawings. In each view, arrows X and Y indicate horizontal directions perpendicular to each other. An arrow Z indicates a vertical direction.

<Printing System>

Figure 1:
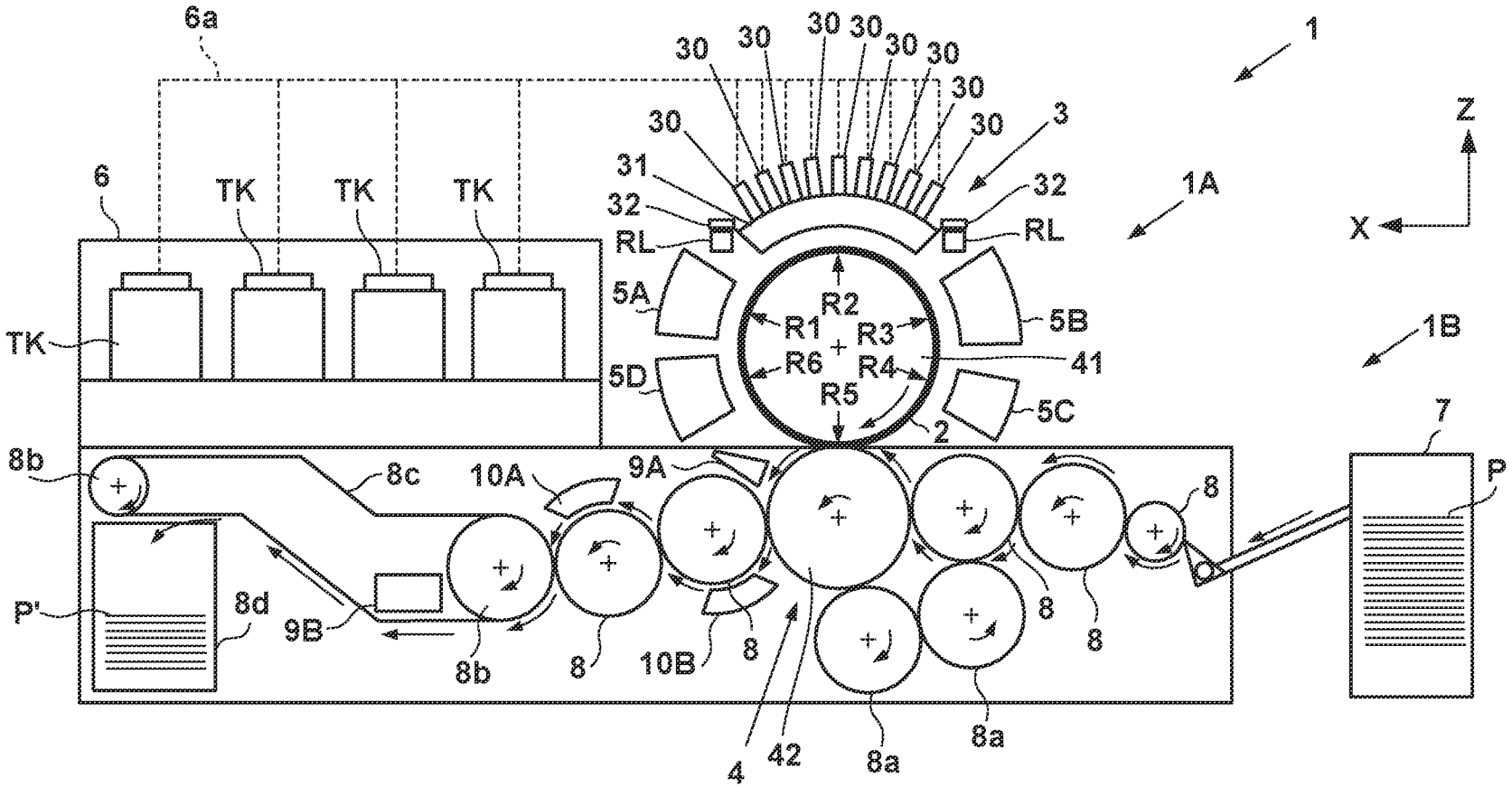
FIG. 1 is a schematic view showing a printing system.

FIG. 1 is a front view schematically showing a printing system (printing apparatus) 1 according to an embodiment of the present invention. The printing system 1 is a sheet inkjet printer that forms (manufactures) a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
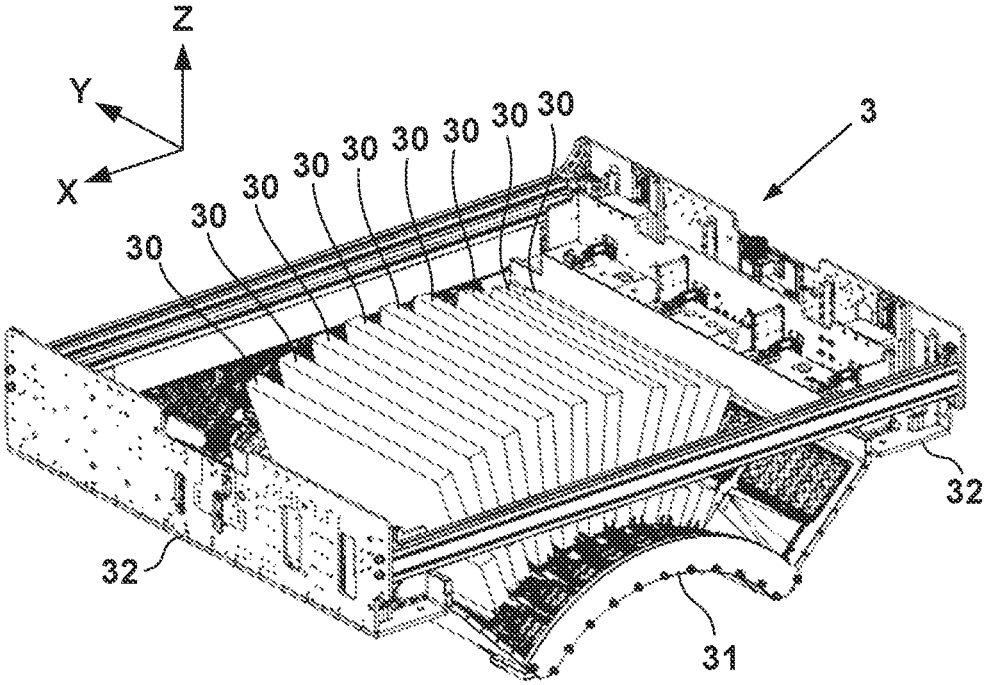
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
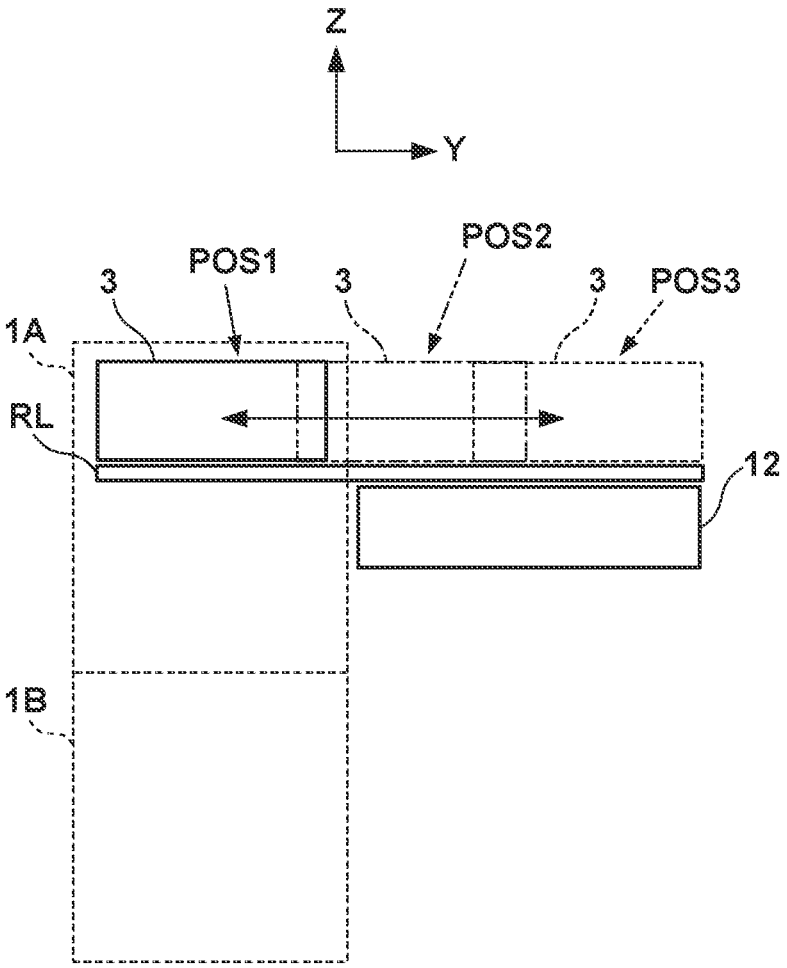
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, and a suction mechanism which sucks ink in the printhead 30 by a negative pressure from the ink discharge surface can be used as such a mechanism.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counterclockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. With respect to durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of these treatments may be combined. It is also possible to provide any desired surface shape in the surface layer.

For example, acrylonitrile-butadiene rubber, acrylic rubber, chloroprene rubber, urethane rubber, silicone rubber, or the like, can be used as a material for the compressed layer. When such a rubber material is formed, a porous rubber material may be formed by blending a predetermined amount of a vulcanizing agent, vulcanizing accelerator, or the like, and further blending a foaming agent, or a filling agent, such as hollow fine particles or salt, as needed. Consequently, a bubble portion is compressed along with a volume change with respect to various pressure fluctuations, and thus, deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials, such as the resin and the ceramic, can be used appropriately. With respect to processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 can share a driving source such as a motor that drives them, and a driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance, such as metal ions, or a polymeric coagulant that causes a pH change in ink and coagulates the coloring material in the ink, and can use an organic acid. For example, a roller, a printhead, a die coating apparatus (die coater), a blade coating apparatus (blade coater), or the like, can be used as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like, contained in the ink or reactive liquid can be used as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing include, for example, coating that aims at protection, improving the glossiness, and the like, of an image on the image printed surface of the printed product P'. For example, liquid application, sheet welding, lamination, and the like, can be used as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
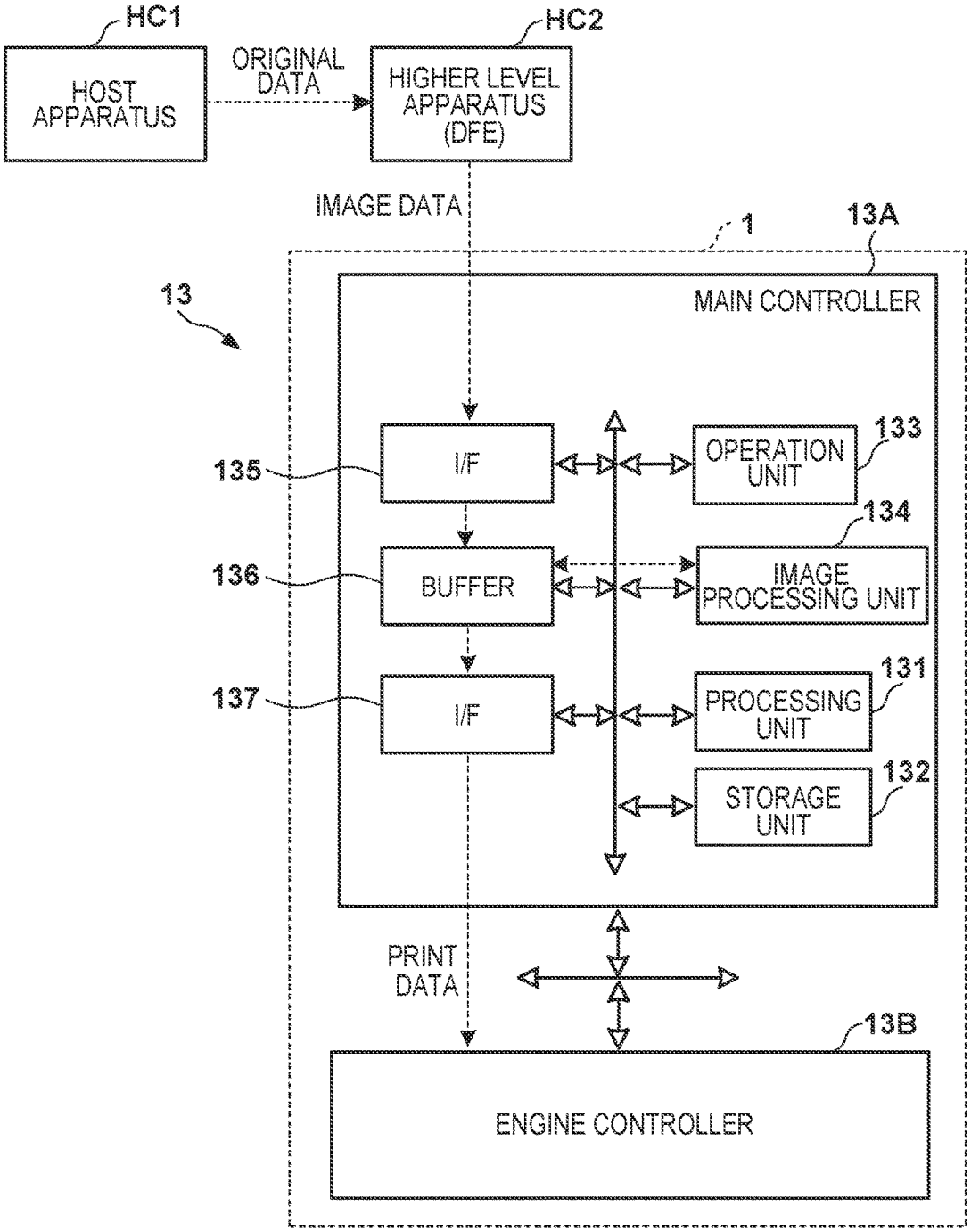
FIG. 4 is a block diagram showing a control system of the printing system in FIG. 1.
Figure 5:
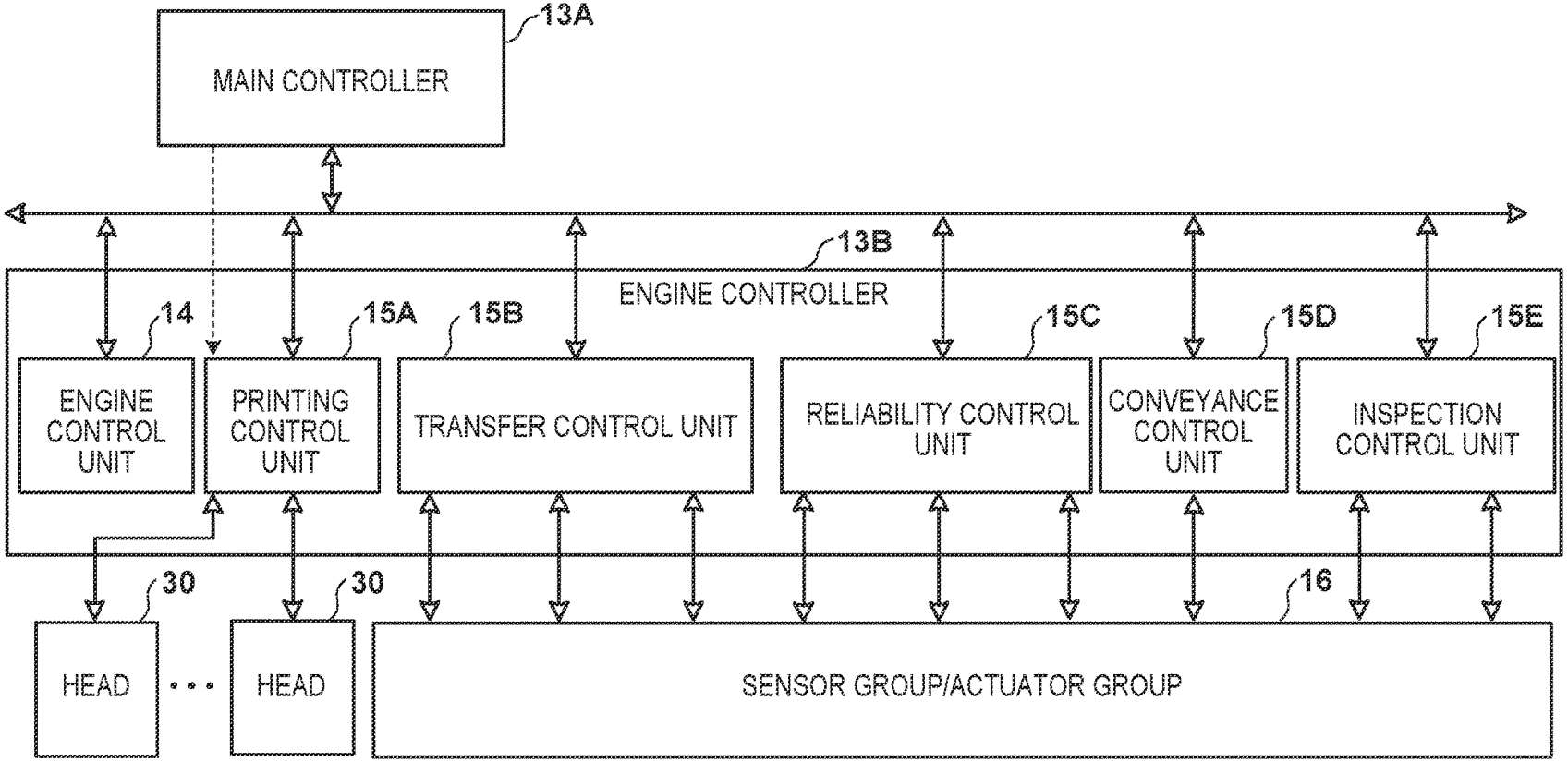
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
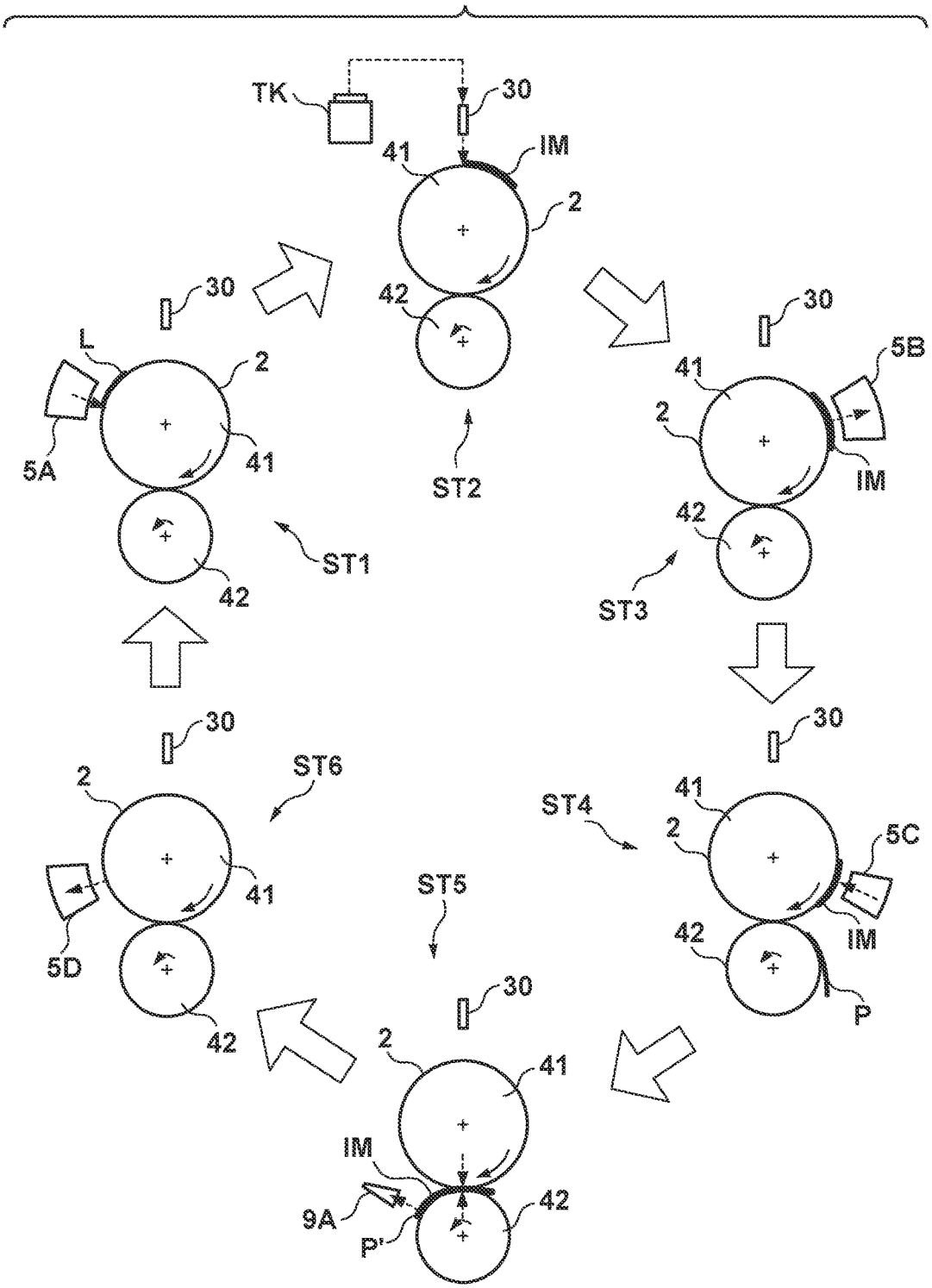
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Figure 7:
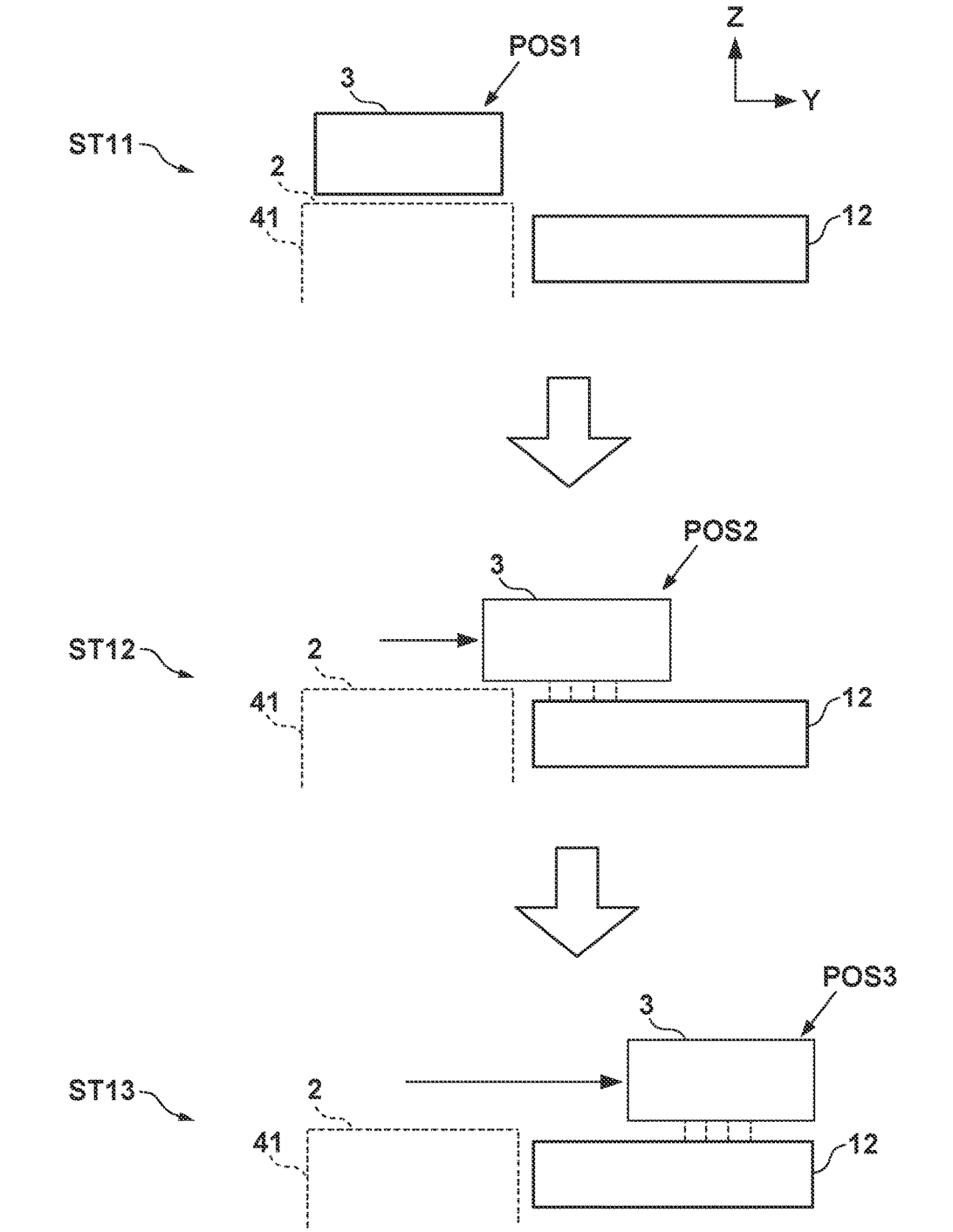
FIG. 7 is an explanatory view showing an example of the operation of the printing system in FIG. 1.
Figure 8A:
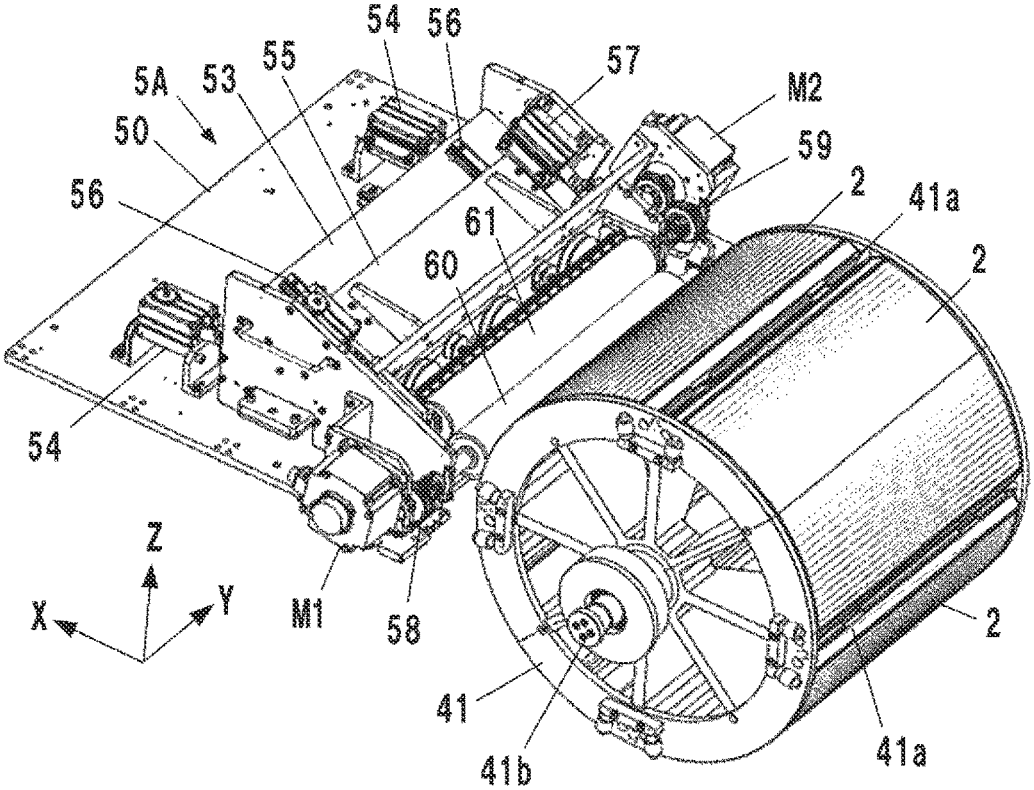
FIGS. 8A and 8B are perspective views each showing an application unit.
Figure 8B:
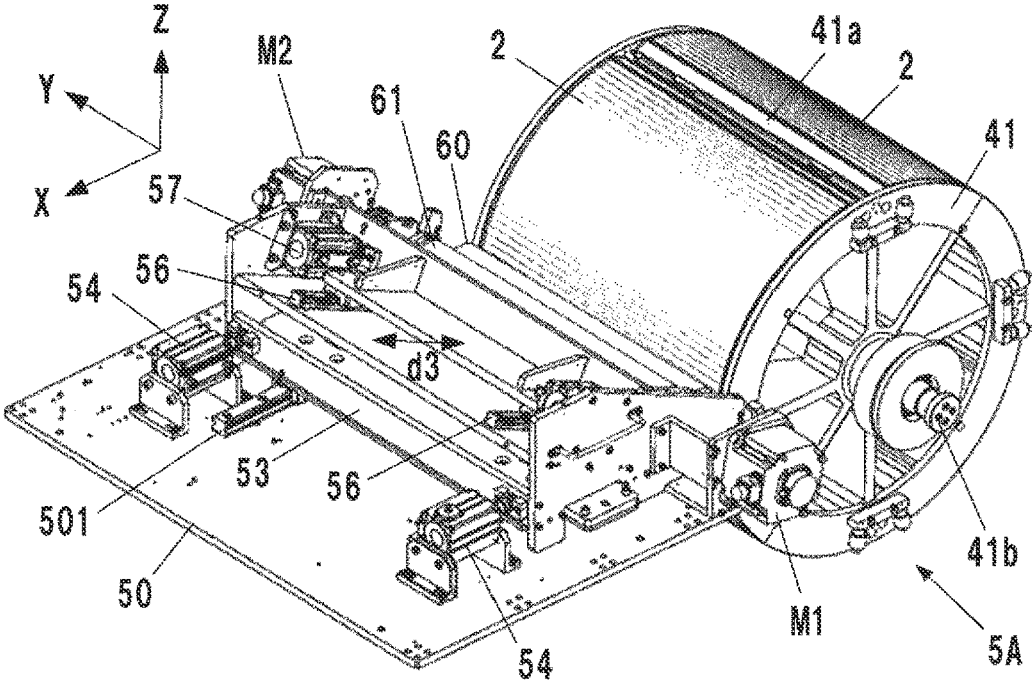

Each printhead 30 needs maintenance if such a printing operation continues. FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

<Application Unit>

An example of the arrangement of the application unit 5A, transfer drum 41, and transfer members 2 will be described with reference to FIGS. 8A to 12. The arrangement of the transfer drum 41 and transfer members 2 will be explained first with reference to FIGS. 8A, 8B, and 9.

Figure 9:
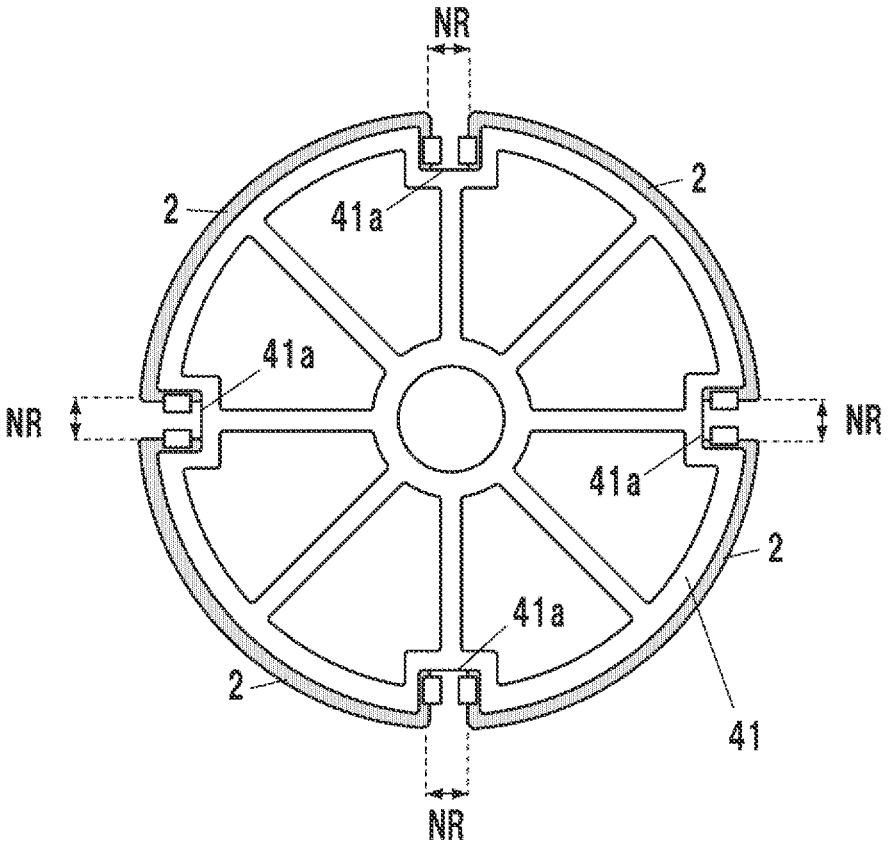
FIG. 9 is a view showing an example of the arrangement of a transfer drum and transfer members.

The transfer drum 41 shown in FIG. 9 and the like includes a cylindrical outer peripheral portion, and concave portions 41*a* are formed at an equal angular pitch (90°-pitch in the example of FIG. 9) around a rotating shaft 41*b*. Each concave portion 41*a* is a space where a gripper that grips the end of the transfer member 2 is arranged. In the example of FIG. 9 and the like, four transfer members 2 (in other words, four segments) are held on the outer peripheral portion of the transfer drum 41 intermittently in a circumferential direction. In this arrangement, the ink image IM is formed on each of the surfaces of the four transfer members 2. Each of the transfer members 2 corresponds to one print medium P. In other words, an arrangement capable of transferring the ink images IM to a maximum of four print media P in one rotation of the transfer drum 41 is adopted.

Concave portions (gaps) NR are formed between the adjacent transfer members. The concave portions NR are regions on the concave portions 41*a*. By rotating the transfer drum 41, the transfer members 2 and the concave portions NR are cyclically moved to a region facing the application unit 5A in the order of the transfer member 2, the concave portion NR, the transfer member, the concave portion NR . . . .

The application unit 5A will be described next with reference to FIGS. 8A to 12. The application unit 5A is a liquid application apparatus capable of applying a liquid (reactive liquid) onto each transfer member 2 by a processing roller 60 before the formation of the ink image IM by the print unit 3.

The application unit 5A includes a plate-like base portion 50. A movement guide unit 51 is provided on the base portion 50. The movement guide unit 51 includes a pair of rails 501 and a plurality of sliders 502 provided on each rail 501. Each rail 501 is elongated in the X direction, and the pair of rails 501 are separated from each other in the Y direction. Each slider 502 is provided to be slidable on the corresponding rail 501. In this embodiment, two sliders 502 are provided on each rail 501, and thus four sliders 502 in total are provided.

A restriction unit 52 is provided on each rail 501. The restriction unit 52 is an electric or fluid actuator (guide brake) that can slide on the rail 501, similarly to the slider 502, while releasably fixing its position at an arbitrary position on the rail 501. The restriction unit 52 is arranged between the two sliders 502. A support unit 53 is supported on the four sliders 502 and the two restriction units 52. This allows the support unit 53 to move in the X direction. By setting the restriction units 52 in a restriction state (position fixed state), interference with the restriction units 52 restricts the movement of the support unit 53 in the X direction.

An actuator 54 that moves the support unit 53 is provided on the base portion 50. In this embodiment, two actuators 54 are provided apart from each other in the Y direction. Each actuator 54 is implemented by, for example, an electric or fluid cylinder, and the extending/contracting direction of a rod is a direction (the X direction in this example) in which the processing roller 60 moves close to/away from the surface of the transfer member 2. The ends of the rods of the actuators 54 are connected to the rear end of the support unit 53, and the actuators 54 are driven to move the support unit 53 back and forth in the X direction. Note that each actuator 54 may be an elastic member such as a spring that biases the support unit 53 toward the transfer drum 41.

The processing roller 60 and the driving unit of the processing roller 60 are supported by the support unit 53. The processing roller 60 is elongated in the Y direction, and is rotatably supported by the support unit 53. The processing roller 60 includes a columnar rotating member 60*a* with a rotating shaft 60*a*', and a processing medium 60*b* covering the outer peripheral portion of the rotating member 60*a*. The processing medium 60*b* is a cylindrical member made of, for example, a rubber material, and forms the obverse layer of the processing roller 60. The processing medium 60*b* is pressed against the surface of the transfer member 2, and applies the reactive liquid onto the surface of the transfer member 2. The processing roller 60 functions as the application roller of the reactive liquid.

The driving unit includes a driving source M1 and a transmission mechanism 58. In this embodiment, the driving source M1 is a motor such as a stepping motor. The transmission mechanism 58 transmits the driving force of the driving source M1 to the processing roller 60. In this embodiment, the transmission mechanism 58 is a gear apparatus, and includes a gear 58*a* that meshes with a gear provided in the output shaft of the driving source M1. FIGS. 12A and 12B respectively show the processing roller 60 in which the gear 58*a* is mounted and the processing roller 60 from which the gear 58*a* is detached. The gear 58*a* is provided with a one-way clutch OWC. The one-way clutch OWC transmits the rotation of the driving source M1 to the processing roller 60 with respect to only rotation in one direction (a d1 direction in FIG. 11 and the like).

Furthermore, a support unit 55 is supported by the support unit 53 via a movement guide unit 56. The movement guide unit 56 has the same arrangement as that of the movement guide unit 51, and is formed from rails and sliders slidable on the rails. The support unit 55 is supported on the sliders of the movement guide unit 56. In the movement guide unit 56, two sets of rails and sliders are provided apart from each other in the Y direction. The rails are elongated in the X direction and a direction (a d3 direction in FIG. 10A and the like) inclined in the Z direction.

An actuator 57 that moves on the support unit 55 is provided on the support unit 53. In this embodiment, two actuators 57 are provided apart from each other in the Y direction. Each actuator 57 is implemented by, for example, an electric or fluid cylinder, and the extending/contracting direction of a rod is a direction (the d3 direction in this example) in which a supply roller 61 moves close to/away from the surface of the processing roller 60. The ends of the rods of the actuators 57 are connected to the rear end of the support unit 55, and the actuators 57 are driven to move the support unit 55 back and forth in the d3 direction. Note that each actuator 57 may be an elastic member such as a spring that biases the support unit 55 toward the processing roller 60.

The supply roller 61 and the driving unit are supported by the support unit 55. The supply roller 61 is elongated in the Y direction, and is rotatably supported by the support unit 55. The supply roller 61 includes a columnar rotating member 61*a* with a rotating shaft 61*a*', and a supply medium 61*b* covering the outer peripheral portion of the rotating member 61*a*. The supply medium 61*b* is a cylindrical member made of, for example, a ceramic material and having an obverse layer on which a number of fine cells are formed, and forms the obverse layer of the supply roller 61. The supply medium 61*b* is pressed against the surface of the processing medium 60*b* of the processing roller 60, and supplies the reactive liquid to the processing roller 60.

The driving unit is a unit that rotates the supply roller 61 and also rotates the processing roller 60 via the supply roller 61. The processing unit includes a driving source M2 and a transmission mechanism 59. In this embodiment, the driving source M2 is a motor such as a stepping motor. The transmission mechanism 59 transmits the driving force of the driving source M2 to the roller 61. In this embodiment, the transmission mechanism 59 is a gear apparatus, and includes a gear 59*a* that meshes with a gear provided in the output shaft of the driving source M2. Similarly to the gear 58*a* described with reference to FIGS. 12A and 12B, the gear 59*a* is also provided with a one-way clutch OWC (not shown), and transmits the rotation of the driving source M2 to the roller 61 with respect to only rotation in one direction (a d2 direction in FIG. 11 and the like).

Figure 10A:
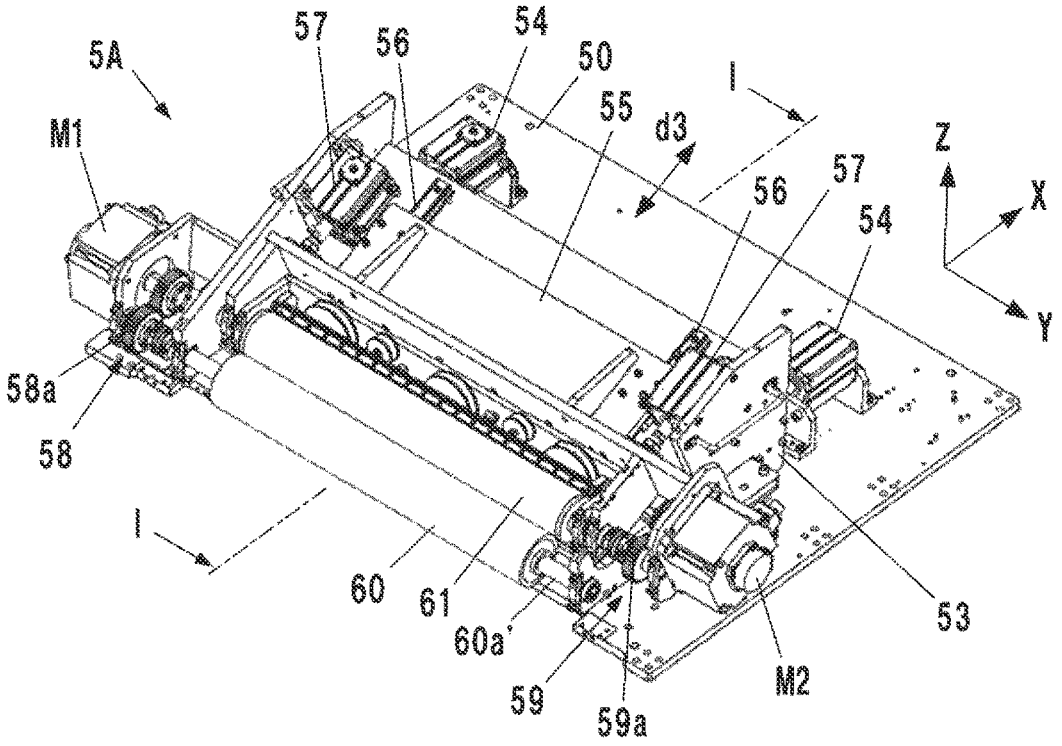
FIG. 10A is a perspective view showing the application unit.
Figure 10B:
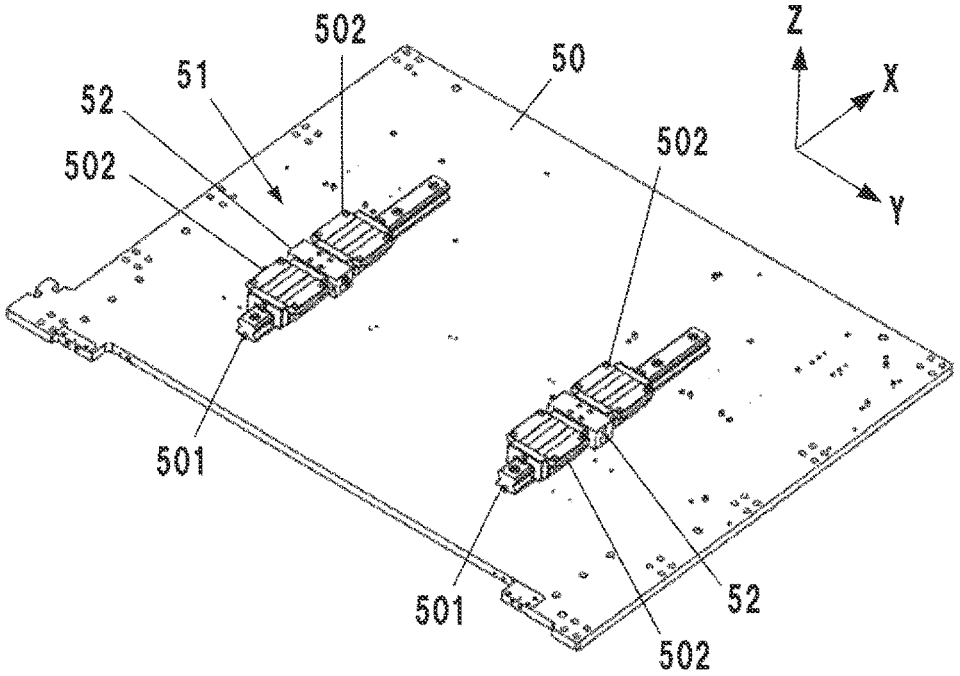
FIG. 10B is a perspective view showing the arrangement of part of the application unit.
Figure 11:
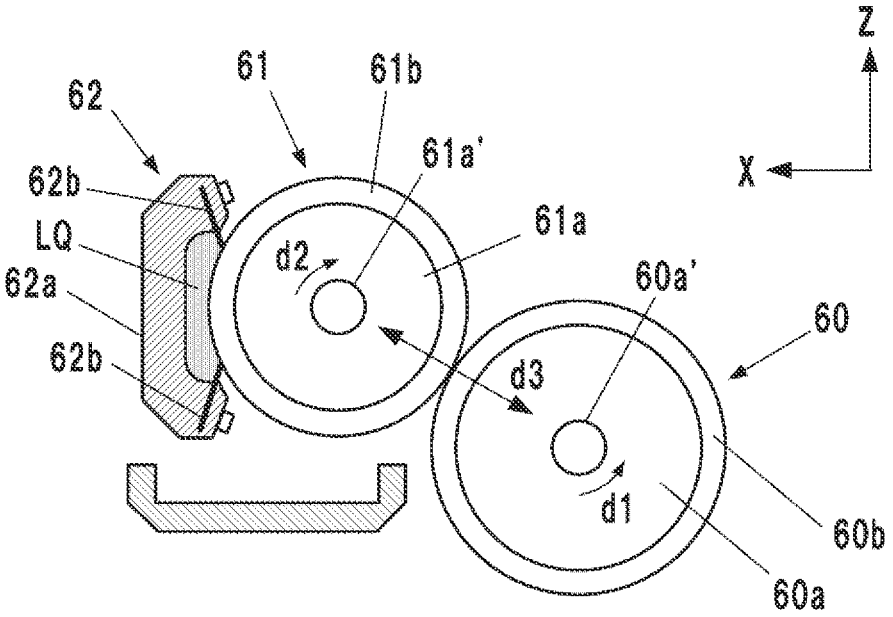
FIG. 11 is a sectional view taken along a line I-I in FIG. 10A and showing a portion around rollers.
Figure 12A:
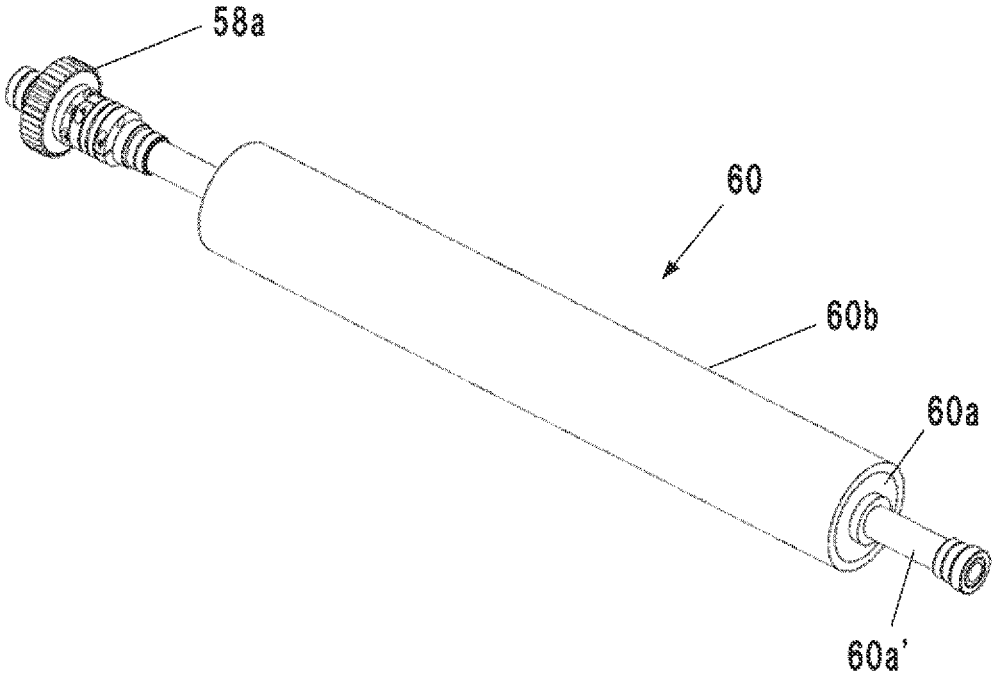
FIGS. 12A and 12B are views for explaining the roller.
Figure 12B:
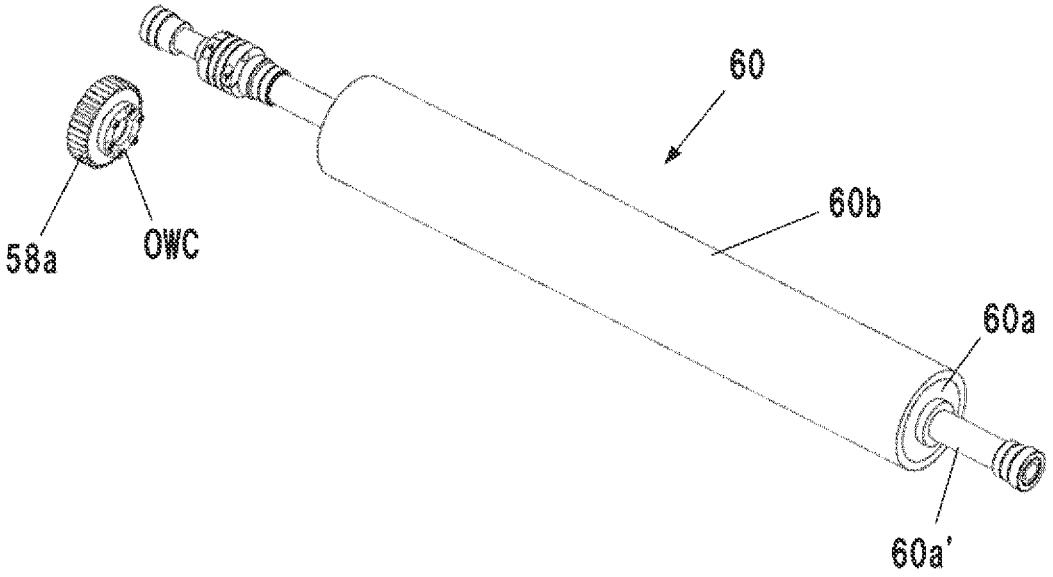

FIG. 11 is a sectional view taken along a line I-I in FIG. 10A and showing a portion around the processing roller 60 and the supply roller 61. A reservoir unit 62 that reserves a reactive liquid LQ is supported by the support unit 55. The reservoir unit 62 includes a reservoir tank (doctor chamber) 62*a* and blades (doctor blades) 62*b*. The reservoir tank 62*a* forms a reservoir space extending in parallel to the longitudinal direction of the supply roller 61, and reserves the reactive liquid LQ in this space. A portion of the supply medium 61*b* of the supply roller 61 is dipped in the reactive liquid LQ in the reservoir tank 62*a*, and the reactive liquid LQ adheres to the surface of the supply medium 61*b* by the rotation of the supply roller 61. Two sets of blades 62*b* are provided apart from each other in the Z direction. Each blade 62*b* extends in parallel to the longitudinal direction of the supply roller 61. The blades 62*b* scrape the extra reactive liquid LQ adhering to the supply roller 61 or the reactive liquid LQ remaining on the supply roller 61.

In the application unit 5A having the above arrangement, the supply roller 61, the driving unit (M2, 59), and the reservoir unit 62 are supported by the support unit 55. If the actuators 57 are driven to move the support unit 55, the overall unit moves close to/away from the processing roller 60. The support unit 55, the processing roller 60, and the driving unit (M1, 58) are supported by the support unit 53.

If the actuators 54 are driven to move the support unit 53, the overall unit moves close to/away from the transfer member 2.

Operation Example

Figure 13:
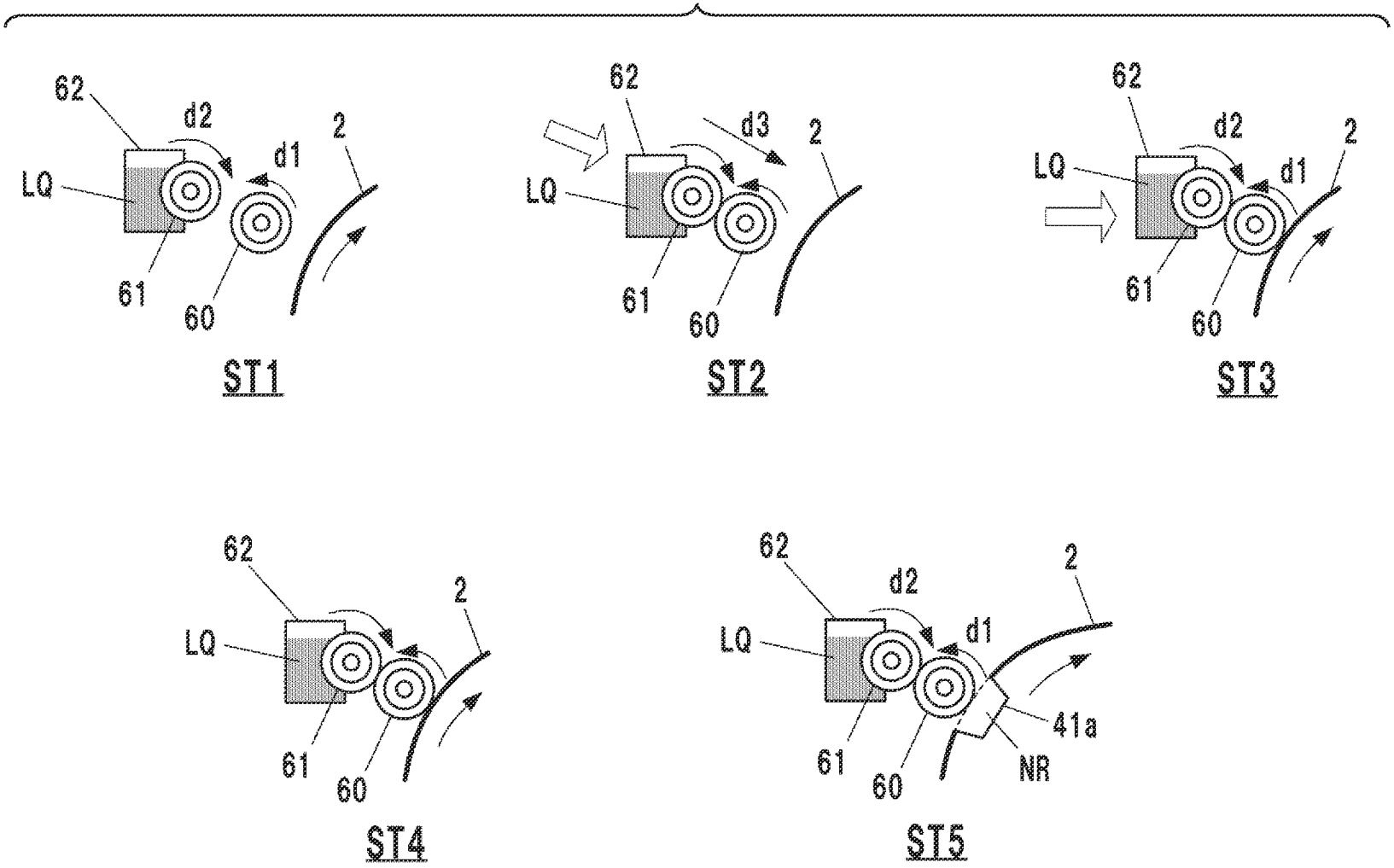
FIG. 13 is a view showing an example of the operation of the application unit.

An example of the operation of the application unit 5A will be described with reference to FIG. 13. The application unit 5A operates under the control of the transfer control unit 15B. States ST1 to ST3 in FIG. 13 show a preparation operation before the start of a printing operation, and states ST4 and ST5 show an operation after the end of the preparation operation. During the printing operation, the application unit 5A is in the state ST4 or ST5.

In a warm-up stage at the start of a system, as shown in the state ST1, the processing roller 60 is arranged at a position separated from the transfer member 2, and the supply roller 61 is arranged at a position separated from the processing roller 60. These arrangements are adjusted by the actuators 54 and 57.

The motors M1 and M2 and the transfer drum 41 start rotating. The peripheral speeds of the processing roller 60, the supply roller 61, and the surface of the transfer member 2 will now be described. Let V2 be the peripheral speed of the surface of the transfer member 2, V60 be the peripheral speed of the processing roller 60, and V61 be the peripheral speed of the supply roller 61. Although the three peripheral speeds are approximated to each other, the rotation speeds of the rollers 60 and 61 and the transfer drum 41 are controlled to satisfy V2>V61>V60.

Running-in of the supply roller 61 is performed by rotating the supply roller 61, and then the reactive liquid LQ adheres to the surface of the supply roller 61. Next, the actuators 57 are driven to move the support unit 55 in the d3 direction, thereby pressing the supply roller 61 against the processing roller 60, as shown in the state ST2. The peripheral speeds of the processing roller 60 and the supply roller 61 have a relationship of V61>V60. Since the peripheral speed of the supply roller 61 is slightly higher, a one-way clutch 58*a'* has no effect, and the processing roller 60 rotates together with the supply roller 61. This performs running-in of the processing roller 60 and the supply roller 61. Although the processing roller 60 rotates together with the supply roller 61, the motor M1 rotates the processing roller 60, thereby reducing the load of the motor M2.

Next, the actuators 54 are driven to move the support unit 53 in the X direction, thereby pressing the processing roller 60 against the transfer member 2, as shown in the state ST3. After pressing, the restriction unit 52 is operated to fix the position of the support unit 53. This fixes the position of the processing roller 60 while maintaining the state in which the processing roller 60 is pressed against the transfer member 2. Even during the printing operation, driving of the motors M1 and M2 is continued.

Since the peripheral speeds of the processing roller 60, supply roller 61, and transfer member 2 have the relationship of V2>V61>V60, the processing roller 60 rotates together with the transfer member 2 and the supply roller 61 rotates together with the processing roller 60 in a section where the processing roller 60 faces the transfer member 2, as shown in the state ST4. The one-way clutch OWC has no effect and the one-way clutch OWC of the supply roller 61 has no effect either. Although the processing roller 60 rotates together with the transfer member 2 directly, the motor M1 rotates the processing roller 60 to reduce the load of the driving source that rotates the transfer drum 41. Although the supply roller 61 rotates together with the transfer member 2 via the processing roller 60, the motor M2 rotates the supply roller 61 to reduce the load of the driving source that rotates the transfer drum 41.

In a section where the processing roller 60 does not face the transfer member 2 and passes through the concave portion NR, as shown in the state ST5, the pressure-contact between the processing roller 60 and the transfer member 2 is temporarily released. However, the position of the processing roller 60 is fixed by the restriction unit 52. In other words, the center distance between the processing roller 60 and the transfer drum 41 is maintained constant. Therefore, the processing roller 60 does not move in a direction to enter the concave portion NR (or concave portion 41*a*). In an arrangement in which the processing roller 60 is simply biased against the transfer member 2, every time the processing roller 60 passes through the concave portion NR, the processing roller 60 may enter the concave portion NR. This may damage the processing roller 60 and the transfer member 2 or generate a strange sound. In this embodiment, however, since the center distance between the processing roller 60 and the transfer drum 41 is maintained constant, the processing roller 60 does not move to the concave portion NR.

Since the processing roller 60 is not pressed against the transfer member 2 in a section where the processing roller 60 passes through the concave portion NR, the processing roller 60 does not rotate together with the transfer member 2. If the peripheral speed of the processing roller 60 greatly decreases, when the processing roller 60 passes through the concave portion NR and is pressed against the transfer member 2 again, the friction between the processing roller 60 and the transfer member 2 may become large. This may wear the surfaces of the processing roller 60 and transfer member 2. In addition, this may change the speed of the transfer drum 41 although the transfer drum 41 basically rotates at a constant speed.

In this embodiment, in a state in which the processing roller 60 is not pressed against the transfer member 2, the driving force of the motor M2 rotates the supply roller 61, and the processing roller 60 rotates together with the supply roller 61. That is, in terms of the relationship between the processing roller 60 and the transfer member 2, the processing roller 60 is not driven-rotated in accordance with the transfer member 2, but is driving-rotated by the driving force of the motor M2 in the section where the processing roller 60 passes through the concave portion NR. Since the peripheral speed of the processing roller 60 does not greatly decrease, when the processing roller 60 passes through the concave portion NR and is pressed against the transfer member 2 again, the friction between the processing roller 60 and the transfer member 2 can be made small. By rotating the processing roller 60 by the motor M1 even in the section where the processing roller 60 passes through the concave portion NR, the load of the motor M2 is reduced. Furthermore, it is possible to reduce damage to the transfer member, and improve the application accuracy of the processing liquid onto the transfer member. This improves the quality of an image formed on the transfer member.

As described above, according to this embodiment, in the arrangement in which the plurality of transfer members 2 are supported in the circumferential direction, it is possible to reduce damage to the transfer member 2 caused by the processing roller 60 and generation of a strange sound.

<Other Examples of Arrangement of Application Unit>

In the above-described example of the application unit 5A, the restriction unit 52 restricts the movement of the support unit 53 in both X directions but may restrict the movement of the support unit 53 in only one direction. That is, it is only necessary to restrict the movement of the processing roller 60 in a direction to enter the concave portion NR.

Figure 14A:
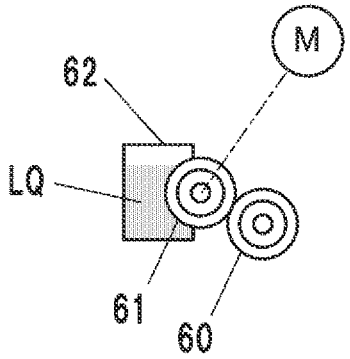
FIGS. 14A to 14C are views for respectively explaining other examples.

In the above-described example of the application unit 5A, the two driving sources (motors M1 and M2) are provided. However, one driving source may be provided. FIG. 14A is a schematic view showing an example. The example of FIG. 14A shows an arrangement in which the supply roller 61 is driven by a motor M. The motor M2 and the transmission mechanism 59 in the above-described example are kept intact, the motor M1 and transmission mechanism 58 of the processing roller 60 are eliminated, and the processing roller 60 is supported to be freely rotatable. The peripheral speeds of the supply roller 61 and transfer member 2 are set to have a relationship of V2>V61. In a state in which the processing roller 60 is pressed against the transfer member 2, the processing roller 60 rotates together with the transfer member 2. In a section where the processing roller 60 passes through the concave portion NR, the processing roller 60 rotates together with the supply roller 61.

Figure 14B:
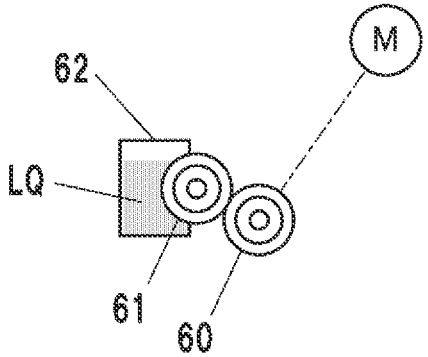

FIG. 14B is a schematic view showing another example. The other example of FIG. 14B shows an arrangement in which the processing roller 60 is driven by the motor M. The motor M1 and the transmission mechanism 58 in the above-described example are kept intact, and the motor M2 and transmission mechanism 59 of the supply roller 61 are eliminated. The supply roller 61 is supported to be freely rotatable. The peripheral speeds of the processing roller 60 and transfer member 2 are set to have a relationship of V2>V60. Unlike the state ST1 of FIG. 13, it is unnecessary to separate the processing roller 60 and the supply roller 61 from each other. The supply roller 61 is always pressed against the processing roller 60 to rotate together with the processing roller 60.

In the above-described example of the application unit 5A, the driving method of the processing roller 60 is automatically switched by the one-way clutch OWC and the peripheral speeds of the rollers 60 and 61 and transfer member 2 in accordance with whether the section is that where the processing roller 60 passes through the concave portion NR. However, the driving method can be switched by electronic control. For example, the rotational phase of the transfer member 2 is detected by a sensor. In a phase in which the processing roller 60 passes through the concave portion NR, the driving source such as a motor drives the processing roller 60. On the other hand, in a phase in which the processing roller 60 is pressed against the transfer member 2, the driving force acting on the processing roller 60 is cut off and is driven-rotated in accordance with the transfer member 2.

Figure 14C:
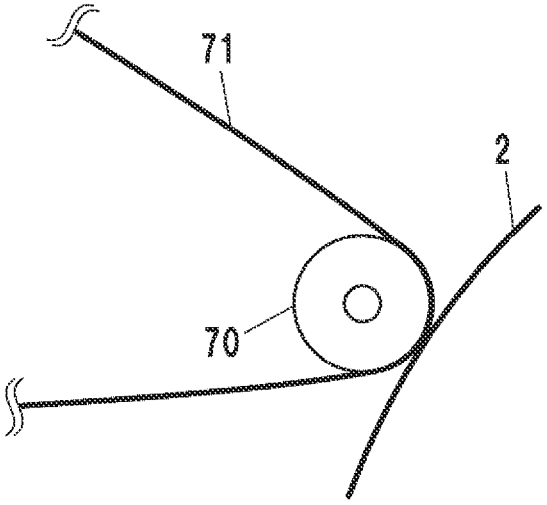

In the above-described example of the application unit 5A, the arrangement in which the processing roller 60 is pressed against the transfer member 2 is adopted. However, an arrangement in which an endless belt as a processing medium is pressed against the transfer member 2 may be adopted. FIG. 14C shows an example. A processing medium 71 as an endless belt is wound around a rotating member 70 such as a pulley, and pressed against the transfer member 2. In this arrangement as well, by setting a constant center distance between the rotating member 70 and the transfer drum 41, it is possible to avoid the rotating member 70 from falling into the concave portion NR. While the processing medium 71 is pressed against the transfer member 2, the processing medium 71 is made to travel in accordance with the transfer member 2. In a section where the rotating member 70 passes through the concave portion NR, the processing medium 71 is driven to travel by the driving force of a driving source such as a motor.

The arrangement of the above-described application unit 5A is not limited to application of the reactive liquid, and is applicable to various processes for the surface of the transfer member 2. For example, the arrangement is applicable to absorption of the liquid by the absorption unit 5B, cleaning of the surface of the transfer member 2 by the cleaning unit 5D, and the like.

Other Embodiments

In the above embodiment, the print unit 3 includes the plurality of printheads 30. However, a print unit 3 may include one printhead 30. The printhead 30 may not be a full-line head but may be of a serial type that forms an ink image while scanning the printhead 30 in a Y direction.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-072080, filed Mar. 31, 2017, which is hereby incorporated by reference herein in its entirety.

What is claimed is:

1. A printing apparatus comprising:

a transfer drum configured to rotate while supporting a plurality of transfer members on each of which an image is formed by discharging ink from a printhead;

a rotating member configured to apply a processing liquid while being pressed against each of the plurality of transfer members;

a concave portion formed lower than a surface of each of the plurality of transfer members between adjacent transfer members; and a driving unit configured to driven-rotate the rotating member in accordance with rotation of the transfer drum in a state in which the rotating member is pressed against the plurality of transfer members, and to driving-rotate the rotating member in a state in which the rotating member faces the concave portion.

2. The apparatus according to claim 1, wherein the rotating member comprises a processing roller configured to apply the processing liquid onto each of the plurality of transfer members before the printhead discharges ink.

3. The apparatus according to claim 2, wherein the driving unit includes:

a driving source; and a one-way clutch configured to transmit a driving force of the driving source to the processing roller, and wherein a rotation speed of the processing roller produced by the driving source is a speed that makes a peripheral speed of the processing roller lower than a peripheral speed of the plurality of transfer members.

4. The apparatus according to claim 2, further comprising a restriction unit configured to restrict movement of the processing roller in a direction to enter the concave portion, wherein the processing roller is supported to be movable to be close to/away from the surface, and wherein the restriction unit releasably fixes a position of the processing roller.

5. The apparatus according to claim 2, further comprising:

a reservoir unit configured to store the processing liquid; and a supply roller having a portion which is dipped in liquid stored in the reservoir unit and configured to supply the liquid to the processing roller while being pressed against the processing roller.

6. The apparatus according to claim 5, further comprising:

a restriction unit configured to restrict movement of the processing roller in a direction to enter the concave portion;

a support unit configured to support the reservoir unit, the processing roller, and the supply roller; and a guide unit configured to guide movement of the support unit with respect to a direction in which the processing roller moves close to/away from the surface, wherein the restriction unit releasably fixes a position of the support unit.

7. The apparatus according to claim 6, further comprising an actuator configured to move the support unit.

8. The apparatus according to claim 6, wherein the reservoir unit and the supply roller are supported by the support unit to be movable with respect to a direction in which the supply roller moves close to/away from the processing roller.

9. The apparatus according to claim 8, further comprising an actuator configured to move the reservoir unit and the supply roller.

10. The apparatus according to claim 1, wherein a plurality of concave portions, in which ends of the plurality of transfer members are held, are formed in an outer peripheral portion of the transfer drum.

11. A control method for a printing apparatus, the printing apparatus including a transfer drum configured to rotate while supporting a plurality of transfer members on each of which an image is formed by discharging ink from a printhead, a rotating member configured to apply a processing liquid while being pressed against each of the plurality of transfer members, and a concave portion formed lower than a surface of each of the plurality of transfer members between adjacent transfer members, the method comprising:

driven-rotating the rotating member in accordance with rotation of the transfer drum in a state in which the rotating member is pressed against the plurality of transfer members; and driving-rotating the rotating member in a state in which the rotating member faces the concave portion.

* * * * *